United States Patent [19]

Ikegami et al.

[11] Patent Number: 4,806,871

[45] Date of Patent: Feb. 21, 1989

[54] SYNCHROTRON

[75] Inventors: Kazunori Ikegami; Souitirou Okuda; Tadatoshi Yamada; Shunji Yamamoto; Tetsuya Matsuda, all of Hyogo, Japan

[73] Assignee: Mitsubishi Denki Kabushiki Kaisha, Tokyo, Japan

[21] Appl. No.: 54,700

[22] Filed: May 27, 1987

[30] Foreign Application Priority Data

| | | | |
|---|---|---|---|
| May 27, 1986 | [JP] | Japan | 61-124022 |
| Aug. 1, 1986 | [JP] | Japan | 61-117469[U] |
| Sep. 25, 1986 | [JP] | Japan | 61-228737 |
| Oct. 13, 1986 | [JP] | Japan | 61-241297 |

[51] Int. Cl.[4] ..... H05H 13/04

[52] U.S. Cl. ..... 328/235

[58] Field of Search ..... 328/235

[56] References Cited

U.S. PATENT DOCUMENTS

| | | | |
|---|---|---|---|
| 2,790,902 | 4/1957 | Wright | 328/235 |
| 2,885,552 | 5/1959 | Anderson | 328/235 |
| 3,344,357 | 9/1967 | Blewett | 328/235 X |
| 3,412,337 | 11/1968 | Lothrop | 328/235 X |

OTHER PUBLICATIONS

Comparison of Different X-ray Sources: X-ray Tubes, Laser Induced Plasma Source, Compact and Conventional Storage Rings, A-Heuberger, Proc. of SPIE-The Int. Soc. for Optical Eng. 1983 Oct. pp. 8-16.

*Primary Examiner*—Palmer C. DeMeo

*Attorney, Agent, or Firm*—Sughrue, Mion, Zinn, Macpeak, and Seas

[57] ABSTRACT

A synchrotron comprises a tubular vacuum chamber forming a closed orbit, charged particles moving around therein; less than four bipolar magnets installed along said vacuum chamber and used to deflect said charged particles; and means for easing the converging action to said charged particles in the horizontal direction due to said bipolar magnets.

10 Claims, 5 Drawing Sheets

SYNCHROTRON

BACKGROUND OF THE INVENTION

This invention relates to a synchrotron for accelerating or accumulating charged particles such as electrons and ions, and more particularly to the miniaturization of the synchrotron.

FIG. 1 shows, for example, a conventional synchrotron shown in "The Design of Synchrotron for Incident Charged Particle", Molecular Science Research Institute (Mar. 1981). As shown in FIG. 1, an inflector 3 for letting beams supplied by an auxiliary accelerator 1 such as a linac or microtron be incident upon a vacuum chamber 4 is installed at the front end of a low energy transport pipe 2. Along the vacuum chamber 4, there are disposed perturbators 5 for shifting the orbit of incident particles, bipolar electromagnets 6 for bending the charged particles to form a closed orbit, tetrapolar electromagnets 7 for focusing the beams, a high-frequency cavity 8 for accelerating the particles, a kicker 9 for bending the orbit of beams at the time of exit, etc. A deflector 10 is used to send out exit beam to a high-energy transport pipe.

The bipolar electrodes 6 and the tetrapolar electrodes 7 located on the curved peripheries are installed at equal intervals and form a circle with six equivalents.

The beams accelerated by the auxiliary accelerator 1 are focused by the tetrapolar electromagnets *7a, 7b* and introduced into the vacuum chamber 4 through the low-energy transport pipe 2 after being bent by the inflector 3. The perturbators 5 introduce the incident beams while outwardly shifting their initial orbit and gradually restoring the orbit to the inside. The incident beams are bent by the bipolar electromagnets 6 and moved in the closed orbit but focused in horizontal and vertical directions while being passed through the tetrapolar electromagnets 7 and otherwise caused to be dispersed therebetween to form a stable mode with six periods a circle.

Upon completion of the aforesaid incidence, the voltage applied to the high-frequency cavity 8 is increased to raise the energy by interlocking the intensity of the magnetic fields of the bipolar electrodes 6 and the tetrapolar electrodes 7 therewith. The kicker 9 is started at the point of time the energy has reached the predetermined level and the beams are thereby deviated from the stabilized orbit and outwardly bent at the deflector 10, whereby they are sent out to the high-energy transport pipe 11.

The beams thus taken out are allowed to divert for a short period and then introduced to a storage ring or an analyzer (not shown) while being focused by tetrapolar electrodes *7e, 7f* attached to the transport pipe 11.

FIG. 2 is a diagram showing the principle of the operation of another conventional synchrotron shown in the "Journal of Japan Physical Society", Vol. 17, No. 4 (1962), pp 271–278, the synchrotron having the same construction as what has been shown in FIG. 1. As shown in FIG. 2, a bipolar deflecting electromagnets 6 form the central orbit 22 of charged particles and, along the central orbit, there are disposed an inflector 3 for making the charged particles supplied by a linear accelerator 1 incident on the synchrotron and a high-frequency cavity 8 for giving energy to the charged beams.

FIG. 3 shows a conventional bipolar deflecting electromagnet 6 equipped with deflecting coils 11 fitted to an iron core 13 by coil clasps 12 and a vacuum chamber 4 through which the charged beams pass. The charged beams supplied by the auxiliary accelerator 1 through the inflector 3 are bent in the deflecting electromagnet 6 and form the closed orbit 22 shown in FIG. 2. The curvature radius δ of the charged beam is proportional to the energy E thereof and inversely proportional to the magnetic field B of the deflecting electromagnet 6, i.e., $$\delta \alpha E/B.$$

When energy is applied to the charged beams by means of the hiqh-frequency cavity 8, the magnetic field of the bipolar deflecting electromagnet 6 is proportionally increased to prevent the closed orbit of the charged beams from changing. This action is generally called the acceleration of charged beams by the synchrotron. The time required for the acceleration normally ranges from 10-several 100 ms. In other words, the bipolar deflecting electromagnet 6 is excited within the time of 10-several 100 ms from a low magnetic field (generally several 10 Gauss) corresponding to incident charged beam energy up to a high magnetic field (generally over 10,000 Gauss) corresponding to accelerated charged beam energy. Consequently, the iron core 13 of the bipolar diflecting electromagnet 6 is usually of laminated construction. FIGS. 4(*a*)–4(*c*) show the configuration of the iron core 13 and FIG. 5 shows the configuration of one of the laminated iron plates 14. In FIG. 4(*b*), a straight line 16 shows the direction in which the iron plates are laminated. Wedge-shaped stuffings 15 are employed to form the fan-shaped iron core 13. As shown in FIG. 6, the wedge-shaped stuffing 15 is formed in such a manner that shifted iron plates are laminated, and offers strength slightly lower than what is provided by an ordinary laminate. The laminated iron plates 14 are laminated between the wedge-shaped stuffings 15. The wedge-shaped stuffings 15 are disposed at equal intervals within the iron core 13 and form the fan-shaped laminated iron core. Each of the both ends of the iron core shown in FIG. 4(*b*) corresponds to a part of the radius of the arc of the fan-shaped core.

In the conventional synchrotrons as described above, more than six bipolar electromagnets are used, which makes synchrotrons large in size and expensive. It is necessary to decrease the number of bipolar electromagnets to make the apparatus compact. However, the problem may arise that the charged particles are forced to collide with the wall of the vacuum chamber and are lost, because the deflection angle of each bipolar electromagnet must be enlarged so that the focusing action to the charged particles in the horizontal direction increases.

An other problem is that, since the kicker 9 and perturbator 5 are arranged on the same linear portion, a connection means such as a flange should be installed therebetween provided each of them is contained in a different vacuum chamber, and the prolonged linear portion makes it difficult to reduce the size of the apparatus.

SUMMARY OF THE INVENTION

It is an object of the invention to provide a compact and inexpensive synchrotron.

The synchrotron according to the present invention comprises a pipe-shaped vacuum chamber in which a closed orbit is formed and through which charged particles pass, four or less of bipolar magnets for deflecting charged particles and means for buffering the focusing action of the charged particles in the horizontal direction, the focusing action being caused by the bipolar magnets.

Since the number of bipolar magnets which should be installed according to the present invention is four or less, the apparatus is made less expensively than the conventional apparatus requiring six of them or more. In the present invention, the deflecting angle of each bipolar magnet becomes greater and the horizontal focusing action to the charged particles increases. However, the means for buffering the focusing action is employed according to the present invention so that the charged particles are prevented from colliding with the wall of the vacuum chamber and being lost.

Also, in the synchrotron according to the present invention, one of the kicker, inflector and deflector as an incidence and exit means is disposed adjacently with the perturbator and these two incidence and exit means are contained in a single vacuum chamber. Therefore, the distance between the kicker, etc, and the perturbator can be made shorter because a flange normally installed therebetween can be dispensed with, whereby the linear portion can be shortened.

Furthermore, each of the bipolar electromagnets contained in the synchrotron according to the present invention is so constructed that the end face of its iron core intersecting the direction wherein the charged particles move around has two faces or more. Therefore, each of the bipolar electromagnets has a minimized portion extending from the vacuum chamber and thereby the linear portion of the vacuum chamber can be shortened. In consequence, a compact apparatus can be made less expensively.

In addition, the bipolar electromagnet according to the present invention has a fan-shaped iron core with both ends formed of only laminated plates, and wedge-shaped stuffings are inserted into only the circular arc portion of the core. Therefore, according to the present invention, not only the mechanical strength of the both ends but also the accuracy of the magnetic field at the both ends are improved.

DETAILED DESCRIPTION OF THE INVENTION

Figure 7:
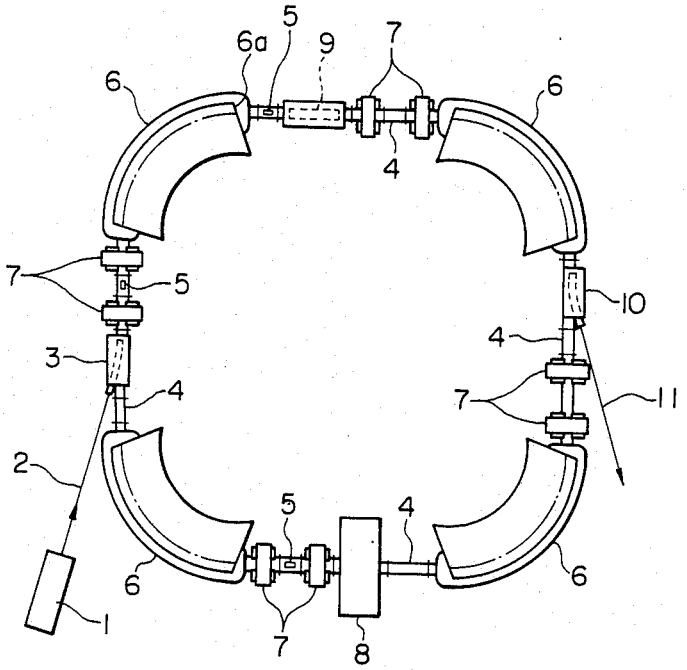
FIG. 7 is a plan view showing the construction of a synchrotron according to a first embodiment of the present invention.
Figure 8:
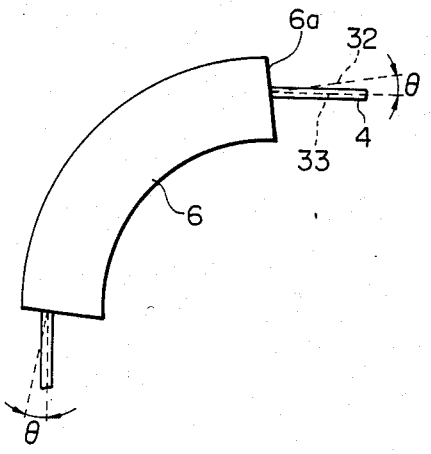
FIG. 8 is an enlarged view showing the proximity of the bipolar electromagnet shown in FIG. 7.

Referring to FIGS. 7, 8, a first embodiment of the present invention will be described. In FIGS. 7, 8, the same reference characters as those in FIG. 1 designate like or corresponding parts.

As shown in FIG. 7, there are installed four bipolar electromagnets 6 along the wall of a vacuum chamber 4 forming a closed orbit. FIG. 8 is an enlarged view of the proximity of the bipolar electromagnet 6. The end face 6*a* of the bipolar electromagnet 6 is formed so that the normal line 32 of the end face 6*a* is located outside the closed orbit formed with the pipe axis 33 of the vacuum chamber 4. The angle of the normal line 32 to the pipe axis 33 is set at about 20°.

The operation of the synchrotron will subsequently be described. The charged particles accelerated by an auxiliary accelerator 1 are sent through a low-energy transport pipe 2 and bent by an inflector 3 before being introduced into the vacuum chamber 4. A perturbator 5 outwardly shifts the orbit of the charged particles initially from the closed orbit and inwardly restores the orbit in sequence while taking in the incident particles. The incident particles are bent by the bipolar electromagnets 6 and caused to move around the closed circuit.

Since four bipolar electromagnets 6 are installed in this embodiment, the deflection angle for the charged particles is as large as 90° and therefore the focusing action within each bipolar electromagnet 6 becomes greater. In this case, however, because the end face 6*a* of the bipolar electromagnet 6 is not perpendicular to the direction wherein the charged particles move forward but because the normal line 32 of the end face 6*a* is located outside the pipe axis 33 as shown in FIG. 8, the charged particles are dispersed in the horizontal direction at the end face 6*a*. That is, the focusing action to the charged particles in horizontal direction is eased so that the charged particles are stably moved along the closed circuit.

Since the four bipolar electromagnets are used to constitute the synchrotron, the occupied area of the apparatus can be reduced and, because the number of parts required is small, it can be manufactured less costly.

Although the angle $\theta$ of the normal line 32 to the pipe axis 33 has been set at about 20°, it may be greater than 15° and less than 25°. In case the angle is set at greater than 25°, the focusing action may be eased to much and, after the charged particles are emitted from the bipolar electromagnet 6, they may collide with the wall of the vacuum chamber 4 in the proximity of the tetrapolar electromagnet 7 and be lost. If the angle $\theta$ is less than 15°, the focusing action may be insufficiently eased and, before the charged particles are emitted from the bipolar electromagnet 6, they may collide with, for instance, the wall of the vacuum chamber 4 in the bipolar electromagnet and lost.

Figure 9:
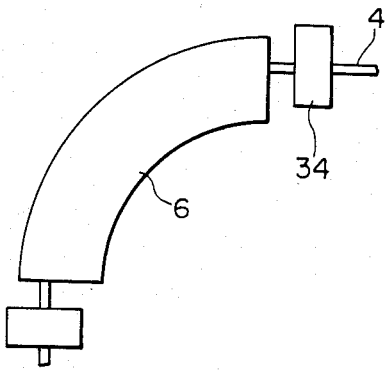
FIG. 9 is an enlarged view showing the proximity of a bipolar electromagnet contained in a synchrotron according to a second embodiment of the present invention.

FIG. 9 shows a second embodiment of the present invention. As shown in FIG. 9, tetrapolar electromagnet 34 are installed at the charged particle incident and exit sides of the bipolar electromagnet 6, respectively, so that the focusing action to the charged particles caused by the bipolar electromagnets 6 in the horizontal direction can be relieved. The same effect is attainable with the aforesaid means in addition to the four bipolar electromagnets 6.

Although the bipolar electromagnet is employed as a bipolar magnet in the aforesaid embodiments, permanent magnets are also usable.

Moreover, although the tetrapolar; electromagnets and the incident and exit equipments have been arranged in the specific positions, they may be disposed in another manner.

There have been installed four bipolar electromagnets together with the means for easing the focusing action in the aforesaid embodiments. However, less than four electromagnets may be installed.

Figure 10:
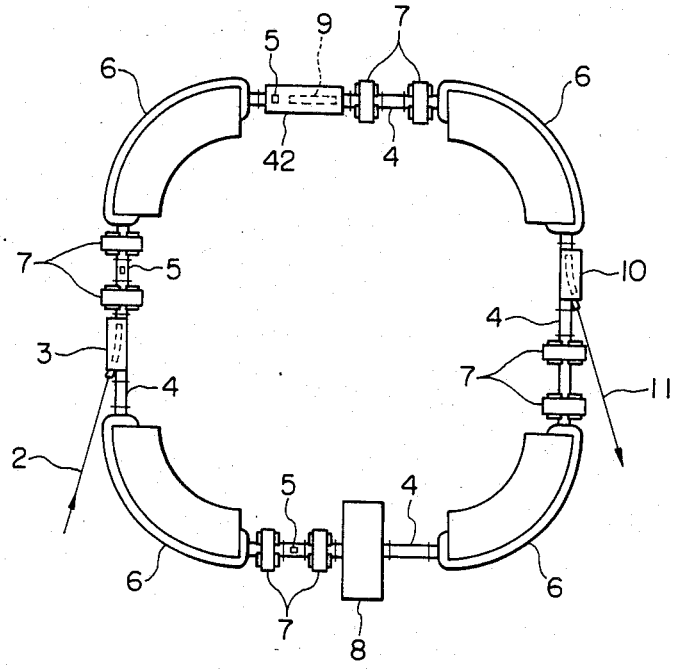
FIG. 10 is a plan view of a synchrotron according to a third embodiment of the present invention.
Figure 11:
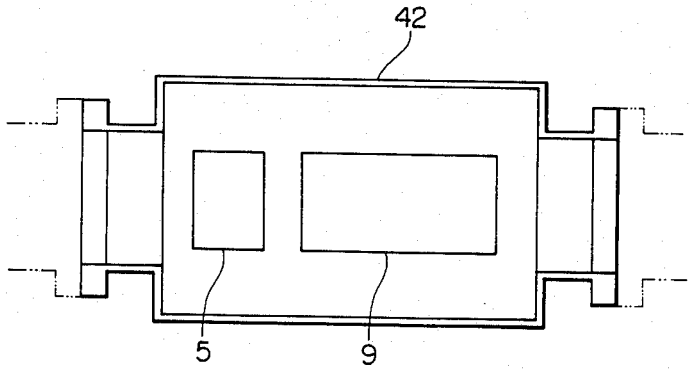
FIG. 11 is a vertical sectional view of the principal part of FIG. 10.

FIGS. 10 and 11 show a third embodiment of the present invention, wherein a perturbator 5 and an adjoining kicker 9 are contained in a K.P. vacuum chamber 42.

Bipolar electromagnets 6 in curved positions and tetrapolar electromagnets 7 are installed at equal intervals and form one circle with four equivalents.

Figure 1:
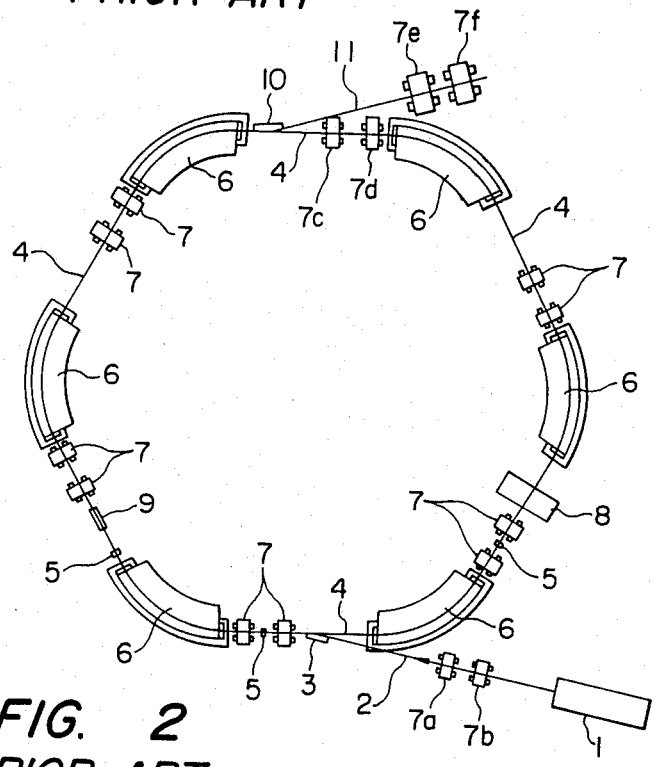
FIG. 1 PRIOR ART
FIG. 1 is a plan view of a conventional synchrotron.
Figure 2:
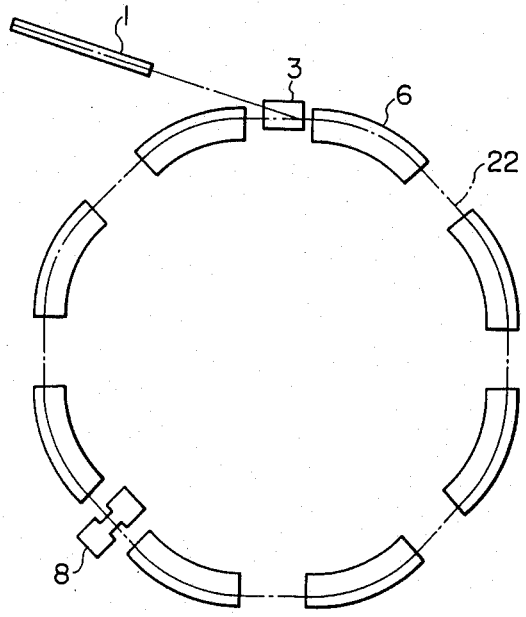
FIG. 2 PRIOR ART
FIG. 2 is a diagram showing the principle of the operation of the conventional synchrotron.
Figure 3:
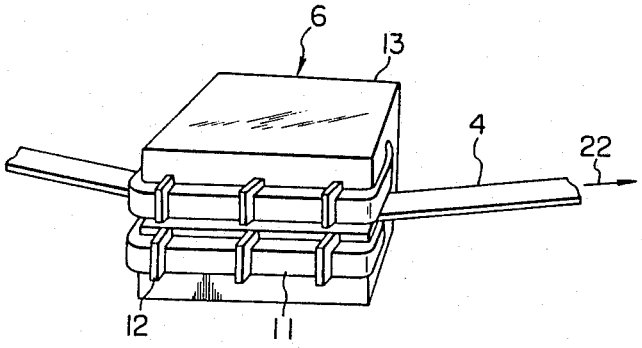
PRIOR ART FIG. 3
FIG. 3 is a perspective view of a conventional bipolar electromagnet.
Figure 4A:
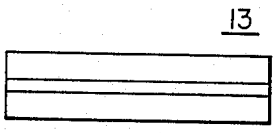
PRIOR ART FIG. 4(a)
FIGS. 4(*a*)–4(*c*) are a plan view, a top view and a side view of the iron core of the conventional bipolar electromagnet.
Figure 4C:
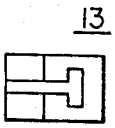
PRIOR ART FIG. 4(c)
Figure 4B:
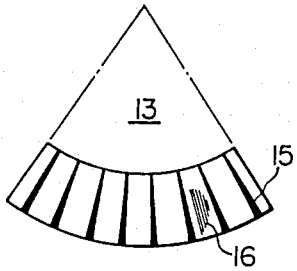

The same reference characters as those in FIG. 1 designate like or corresponding parts.

The operation of this embodiment will subsequently be described. The perturbator 5 outwardly shifts the orbit of incident beams while taking them in and gradually restores the orbit to the inside. Upon completion of the incidence and acceleration by means of a high-frequency cavity 8, a kicker 9 is operated and the beams are shifted from the stable orbit and allowed to reach the position of the deflector 10. The beams are outwardly bent at the position and sent out to a high-energy transport pipe 11.

In view of power efficiency, the perturbator 5 and the kicker 9 should preferably be positioned close to the beam and, for this purpose, they are contained in the K.P. vacuum chamber 42. Conventionally, incidence and exit equipments such as the perturbator 5 and the kicker 9 are respectively contained in different vacuum chambers. According to the present embodiment, both of them are contained in one single vacuum chamber 42 without damaging the aforesaid operation.

A description has been given of a four-period synchrotron in : the aforesaid embodiments of the present invention. However, the number of periods may be different.

Further, although it has been arranged that the perturbator and the kicker are contained in one single vacuum chamber, the same effect is attainable by installing the combination of other incidence and exit equipment such as an inflector and a deflector and a perturbator.

Figure 12:
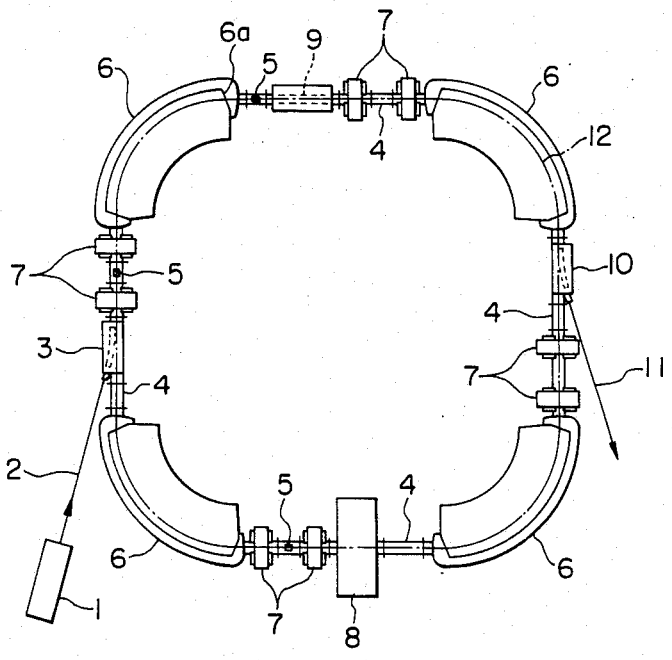
FIG. 12 is a plan view of a synchrotron according to a fourth embodiment of the present invention.
Figure 13:
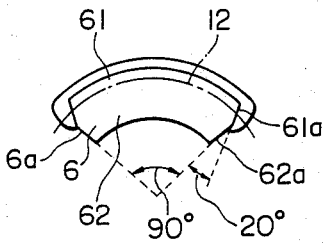
FIG. 13 is a plan view of the bipolar electromagnet of FIG. 12.

Referring to FIGS. 12, 13, a fourth embodiment of the present invention will be described. FIG. 12 is a plan view showing the construction of a synchrotron as a fourth embodiment of the present invention. FIG. 13 is a plan view of the bipolar electromagnet according to this embodiment.

In FIGS. 12 and 13, bipolar electromagnets 6 are installed on the periphery of a vacuum chamber 4 and composed of first iron cores 61 interposing the vacuum chamber 4 and a second iron core 62 for connecting the first iron cores, whereas an end face 61*a* of the first iron core 61 and an end face 62*a* of the second iron core 62 does not make the same plane. The angle between the normal line of the end face 61*a* directed to the outside of the iron core and the pipe axis of the vacuum chamber 4 is set e.g., at 20° and the end face 62*a* is set perpendicular to the pipe axis (i.e., the end face 61*a* makes an angle of 20° relative to the end face 62*a* as shown in FIG. 13).

The operation will subsequently be described. The charged particles accelerated by the auxiliary accelerator 1 are sent through the low-energy transport pipe 2 and bent by the inflector 3 before being introduced into the vacuum chamber 4. The perturbator 5 outwardly shifts the orbit of the charged particles initially from the closed orbit and inwardly restores the orbit in sequence while taking in the incident particles. The incident particles are bent by the bipolar electromagnets 6 and caused to move around the closed circuit.

Since the end face 61*a* of the iron core of the bipolar electromagnet intersecting the vacuum chamber is not perpendicular to the direction wherein the charged particles move around, the end face causes the charged particles to be diverted in the horizontal direction at the entrance and exit, whereas the diverting action is offset by the converging action in the deflecting portion, so that the charged particles are kept stable.

Moreover, since the end fact 62*a* of the iron core not intersecting the vacuum chamber is perpendicular to the axis of the vacuum chamber, the bipolar electromagnet 6 can be made compact and its protrusion toward the linear portion is also minimized, and further , the bipolar electromagnet does not obstruct the arrangement of other equipments such as the tetrapolar electrodes and the incidence and exit equipments.

Although the tetrapolar electrodes and the incidence and exit equipments have been arranged in the specified manner in the aforesaid embodiments, they may be disposed differently.

Although synchrotrons have been referred to in the aforesaid embodiments, the present invention is applicable to a charged particle accumulator with the same effect.

Further, there has been shown the end face 6*a* of the iron core composed of two faces. However, it may be composed of more than two faces or has a curved surface.

Figure 5:
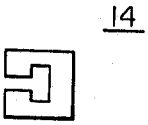
PRIOR ART FIG. 5
FIG. 5 is a side view of one of laminated iron plates constituting the iron core of FIG. 4.
Figure 6:
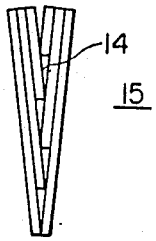
PRIOR ART FIG. 6
FIG. 6 is a sectional view of the wedge-shaped stuffing shown in FIG. 4.
Figure 14:
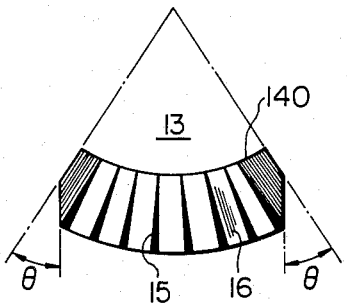
FIG. 14 is a plan view of the principal part of an iron core contained in a synchrotron according to a fifth embodiment of the present invention.

FIG. 14 shows a fifth embodiment of the present invention, wherein each iron core 13 has end portions turned by $\theta$ to change the converging force to the charged particles (i.e., to add the edge effect). Both ends of the iron core 13 are made of only laminated iron plates 140, each of which has a shape different from each other. More specifically, iron plates as shown in FIG. 5 are cut out at the magnetic side (the left-hand side) by slightly different amount for each and are formed into the laminated iron plates 140. The wedge-shaped stuffings 15 are inserted only in the circular arc portion of the iron core.

According to the above-mentioned structure, since the wedge-shaped stuffing 15 is not inserted in both ends of the iron core 13, the mechanical strength of the end portion is improved, and it becomes possible to obtain an excellent edge effect free from magnetic field disturbance resulting from minute gaps in the wedge-shaped stuffing 15.

According to the first and second embodiments of the present invention, the synchrotron comprises the tubular vacuum chamber wherein the closed orbit is formed and the charged particles are moved around, less than four bipolar electrodes for deflecting the charged particles and means for easing the converging action to the charged particles in the horizontal direction, so that a compact, inexpensive synchrotron is obtainable.

According to the third embodiment thereof, since the perturbator and the kicker are contained in a single vacuum chamber, not only the linear portion but also the synchrotron itself can be decreased in size, so that an inexpensive synchrotron is manufactured.

According to the fourth embodiment thereof, since the end face of the iron core of the bipolar electromagnet intersecting the direction wherein the charged particles are moved around is composed of two or more faces, a compact and inexpensive synchrotron is obtainable.

According to the fifth embodiment thereof, since both ends of the iron core are composed of only laminated iron plates and the wedge-shaped stuffings are inserted in only circular arc portion of the iron core, the mechanical strength of the end portion thereof is increased and the magnetic field disturbance at each end is reduced effectively.

What is claimed is:

1. A synchrotron, comprising:

a tubular vacuum chamber forming a closed orbit; means for moving charged particles around said orbit;

less than five bipolar magnets installed at substantially equal intervals along said vacuum chamber for deflecting said charged particles, said magnets causing a converging action on said charged particles and wherein said magnets are connected along a pipe axis; and means for easing the converging action on said charged particles in the horizontal direction, characterized by each end face of each of said bipolar magnets being oriented such that a line perpendicular to each of said end faces is directed to the exterior of said closed orbit formed along said pipe axis in said vacuum chamber.

2. A synchrotron as claimed in claim 1, wherein an angle between said normal line and said pipe axis of said vacuum chamber is within a range of 15° to 25°.

3. A synchrotron comprising:

a tubular vacuum chamber forming a closed orbit;

means for moving charged particles around said orbit;

less than five bipolar magnets installed at substantially equal intervals along said vacuum chamber for deflecting said charged particles, said bipolar magnets causing a converging action on said charged particles; and means for casing the converging action on said charged particles in the horizontal direction, wherein said means for easing the converging action is composed of tetrapolar magnets, each being installed at incident and exit sides of each of said bipolar 4. A synchrotron as claimed in claim 1, wherein said bipolar magnet is a bipolar electromagnet.

5. A synchrotron comprising:

a tubular vacuum chamber forming a closed orbit;

means for moving charged particles around said orbit;

less than five bipolar magnets installed at substantially equal intervals along said vacuum chamber for deflecting said charged particles, said bipolar magnets causing a converging action on said charged particles and wherein said magnets are connected along a pipe axis; and means for easing the converging action on said charged particles in the horizontal direction, wherein each of said bipolar magnets comprises an iron core including first iron core parts interconnecting said vacuum chamber and a second iron core part connecting said first iron core parts, wherein end faces of said iron core intersecting the moving direction of charged particles is composed of two planes or core, and a line perpendicular to a plane of said first iron core parts, arranged toward the exterior of said iron core, is directed to the exterior of said closed orbit formed along said pipe axis of said vacuum chamber.

6. A synchrotron as claimed in claim 5, wherein an angle between said normal line and said pipe axis of said vacuum chamber is within a range of 15° to 25°.

7. A synchrotron as claimed in claim 5, wherein an end face of said second iron core part is set perpendicular to said pipe axis of said vacuum chamber.

8. A synchrotron as claimed in claim 5, wherein said iron core is formed into a fan-shaped figure with laminated iron plates and wedge-shaped stuffings inserted therebetween, wherein each end of said iron core is composed of only laminated iron plates and said wedge-shaped stuffings are inserted in only an arc portion of said fan-shaped iron core.

9. A synchrotron, comprising:

a tubular vacuum chamber forming a closed orbit;

means for moving charged particles around said orbit;

less than five bipolar magnets installed at substantially equal intervals along said vacuum chamber for deflecting said charged particles, said magnets causing a converging action of said charged particles;

means for easing the converging action on said charged particles in the horizontal direction;

an inflector disposed between two of said magnets for causing said charged particles to be incident on said vacuum chamber;

a kicker disposed between two of said magnets for bending an orbit of exiting charged particles;

a deflector disposed between two of said magnets for sending out said exiting charged particles to a high-energy transport pipe; at least one perturbator disposed between two of said magnets, wherein one of aid kicker, inflector and deflector, and said perturbator are contained in a single vacuum chamber installed along said tubular vacuum chamber and wherein others of said kicker, inflector and deflector are installed along said tubular vacuum chamber.

10. A synchrotron as claimed in claim 9, wherein said tubular vacuum chamber includes four linear portions.

* * * * *